United States Patent [19]

Humpolik et al.

[11] Patent Number: 4,891,257

[45] Date of Patent: Jan. 2, 1990

[54] CARRIER MATRIX, PARTICULARLY FOR A CATALYTIC REACTOR FOR THE EXHAUST EMISSION CONTROL IN THE CASE OF INTERNAL-COMBUSTION ENGINES

[75] Inventors: Bohumil Humpolik, Ludwidgsbrug; Josef Mielke, Schwieberdingen, both of Fed. Rep. of Germany

[73] Assignee: Sueddeutsche & Kuehlerfabrik Julius Fr. Behr GmbH, Fed. Rep. of Germany

[21] Appl. No.: 905,590

[22] Filed: Sep. 11, 1986

[30] Foreign Application Priority Data

Sep. 11, 1985 [DE] Fed. Rep. of Germany ..... 3532408

[51] Int. Cl.[4] ..... B01J 35/04; B21D 53/00; F01N 3/28

[52] U.S. Cl. ..... 428/592; 428/593; 502/439; 72/147; 72/148; 29/157 R

[58] Field of Search ..... 428/577, 586, 592, 593; 502/439, 527; 72/148, 146, 147; 29/157 R, 240; 242/77.1; 422/180

[56] References Cited

U.S. PATENT DOCUMENTS

| | | | |
|---|---|---|---|
| 1,006,784 | 10/1911 | Payet | 242/77.1 |
| 1,596,962 | 8/1926 | Geddes | 242/77.1 |
| 1,799,713 | 4/1931 | Walker | 242/77.1 |
| 2,143,451 | 1/1939 | Podbielniak | 72/148 |
| 2,349,946 | 5/1944 | Durr | 242/77.1 |
| 2,526,657 | 10/1950 | Guyer | 502/527 |
| 2,936,882 | 5/1960 | Kreuthmeier | 242/77.1 |
| 3,405,879 | 10/1968 | Anger | 242/77.1 |
| 3,857,680 | 12/1977 | Porta et al. | 502/527 |
| 4,152,302 | 5/1979 | Nonnenmann et al. | 502/527 |
| 4,221,843 | 9/1980 | Mundy | 428/594 |
| 4,598,063 | 7/1986 | Retallick | 502/439 |
| 4,647,435 | 3/1987 | Nonnenmann | 422/180 |
| 4,719,680 | 1/1988 | Cyron | 502/439 |

FOREIGN PATENT DOCUMENTS

| | | | |
|---|---|---|---|
| 2302746 | 1/1973 | Fed. Rep. of Germany . | |
| 2856030 | 12/1976 | Fed. Rep. of Germany . | |
| 425720 | 4/1974 | U.S.S.R. | 72/146 |

OTHER PUBLICATIONS

M. Nonnenmann, "Metal Supports for Exhaust Gas Catalysts", SAE Technical Paper Series, No. 850131, 1985, pp. 1–8.

Behr, Metalit, Metallträger für Abgaskatalysatoren, brochure by Behr GmbH & Co. KG, 1 page.

*Primary Examiner*—John J. Zimmerman

*Attorney, Agent, or Firm*—Barnes & Thornburg

[57] ABSTRACT

A carrier matrix wound of a carrier strip having undulations in its transverse direction has deflections of the carrier strip, said deflections being arranged in planes. During the winding process, the deflections are created by the insertion of deflection pins between the corresponding winding layers. The deflections pins, in this case, are inserted between the winding layers as a function of the desired cross-section of the carrier matrix so that after the winding process and after the removal of the deflection pins, the carrier matrix can be inserted into a sheath that has the desired cross-section of the carrier matrix. By combining several winding bodies of this type into one carrier matrix, arbitrary cross-sections of carrier matrices can be produced, particularly cross-sections having concave archings. During the making process, the deflection pins are fitted through the corresponding bores of two winding disks that are connected with one another in a torsionally fixed way. The carrier matrix that is produced in this way can then be inserted into a sheath. This can be accomplished by a funnel-shaped arrangement.

37 Claims, 3 Drawing Sheets

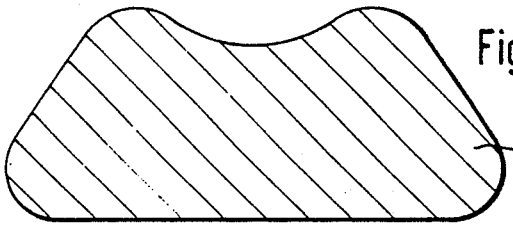
Fig. 4a
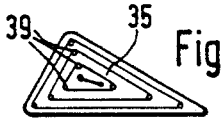
Fig. 4b
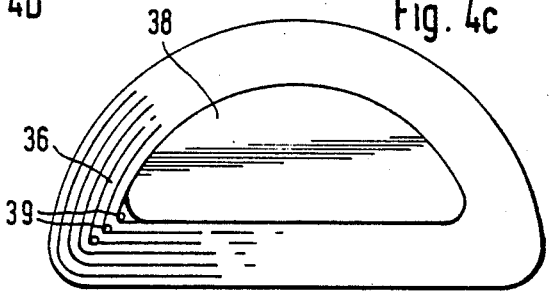
Fig. 4c
Fig. 5
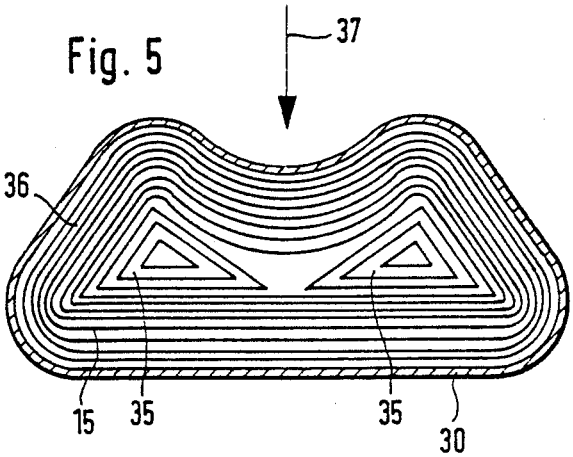

Fig. 6
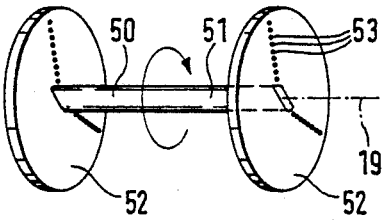
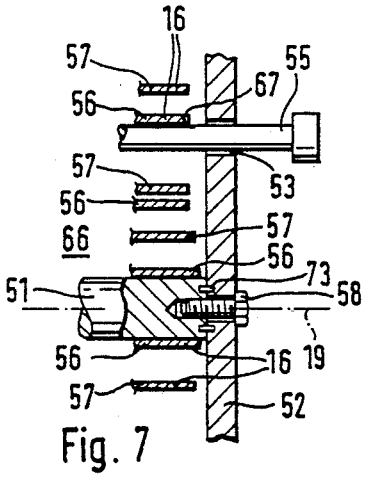
Fig. 7
Fig. 8
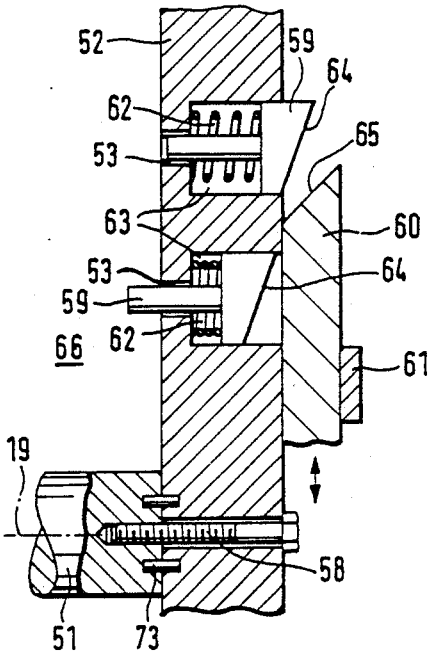
Fig. 9
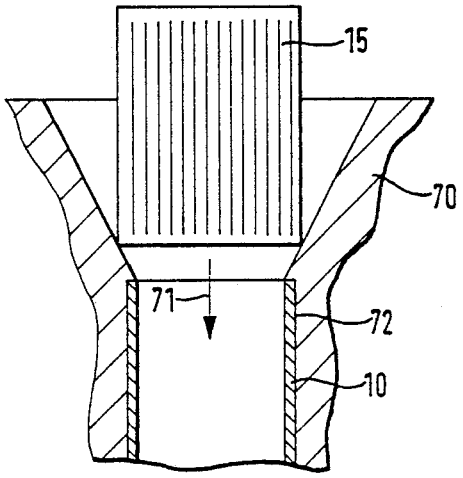

CARRIER MATRIX, PARTICULARLY FOR A CATALYTIC REACTOR FOR THE EXHAUST EMISSION CONTROL IN THE CASE OF INTERNAL-COMBUSTION ENGINES

BACKGROUND AND SUMMARY OF THE INVENTION

The present invention relates to a carrier matrix, particularly for a catalytic reactor for the exhaust emission control in internal-combustion engines, having at least one carrier strip that has undulations in its transverse direction and of which the carrier matrix is wound and is then covered by a sheath.

A carrier matrix of this type is shown in German Unexamined Published Application 2,302,746. There, smooth strips are rolled off two delivery spools, one of said strips being Profiled by an undulating machine. Subsequently, the undulated and the smooth strip, via deflection rollers, are fed to a winding machine that winds the two strips onto a winding core. This results in a carrier matrix in which the smooth and the undulated strip wind themselves spirally around the winding core.

It is also shown in German Unexamined Published Application 2,856,030 to provide as the winding core a circular or an oval cylinder that, after the winding process, is pulled out of a carrier matrix. The resulting hollow space, after the winding process, is closed by pressing, the cross-section of the winding body being changed in the process. These changing possibilities are limited to elliptic or flat-oval shapes because otherwise the carrier strip itself would be deformed and damaged.

The above-described carrier matrices therefore have the disadvantage that they can have only circular or oval cross-sections. It is therefore not possible to fit the above carrier matrices into a given space in a motor vehicle, for example, in a drive shaft tunnel of a motor vehicle.

It is an objective of the invention to provide a metallic carrier matrix as well as a process and a device for its manufacturing, the carrier matrix having an arbitrarily suppliable cross-section and thus being optimally adaptable to existing spaces of a motor vehicle.

This and other objectives are achieved by a carrier matrix wound with a plurality of deflections of the carrier strip that are substantially in at least one longitudinally extending plane.

In a preferred embodiment, the planes in which the deflections are located intersect. This has the result that the carrier matrix can have, for example, trapezoid or triangular cross-sections. It is especially advantageous for the carrier strip to extend in a straight line in front of and behind the deflections. This makes possible for a matrix having a triangular cross-section, for example, the precise maintaining of desired angles.

An advantageous development of certain preferred embodiments of the invention is that the carrier matrix comprises several wound carrier matrix parts. This makes it possible to provide a carrier matrix having a cross-section with concave arching.

In a process for the manufacturing of a carrier matrix according to the invention, deflection means are inserted during the winding process between the wound layers of the carrier strip for providing the deflections of the carrier strip. In a preferred embodiment of this process, the deflections means are each successively inserted in the outer winding layer. Thus, the carrier strip by means of the deflecting means is lifted off the winding layer located under it and the deflection is developed by the placing of the carrier strip around the deflection means.

After the winding process, in preferred embodiments, the deflection means are removed out of the carrier matrix and the carrier matrix, while deforming takes place, is inserted into the sheath that has the final shape of the carrier matrix. The carrier matrix in this contemplated process is shaped into the shape of the sheath either before or during the insertion into the sheath. By this measure, hindrance by the deflection means of the exhaust gases that flow during operation through the carrier matrix, is prevented and therefore, the operability of the carrier matrix is not limited. At the same time, the desired cross-section of the carrier matrix that is produced by the deflection means is maintained.

In an advantageous further development of certain preferred embodiments, the distance of the deflection means over which the carrier strip is wound successively during the continuous winding, corresponds to the length of the carrier strip between the deflections, after the carrier matrix, while deforming is taking place, is inserted into the sheath. Thus, the physical position of the deflection means is not dependent on the desired cross-section of the carrier matrix, so that the deflection means may be inserted solely as a function of their distance between the winding layers of the carrier strip. In this case, it is especially advantageous to arrange the deflection means on lines in a star-shaped arrangement. As a result, it is possible to wind the carrier matrix with a high and uniform winding speed, without having to provide complicated winding drives.

Another advantageous development comprises providing the carrier strip before it is wound with weak points that are assigned to the deflections. This measure has the effect that the deflection points by means of the bends or perforations existing in the carrier strip can be developed even better and more precisely.

A preferred embodiment of a device for making a carrier matrix according to the invention comprises two disks connected with one another in a torsionally fixed manner by a rotating shaft. The device has a rotary drive, with at least one of the disks, at a distance from the axis of rotation, being provided with receiving means for the deflection means. By this arrangement, it is possible to produce the deflections at the same time with the winding of the carrier strip by inserting the deflection means. An especially advantageous feature of certain preferred embodiments is that the deflecting means are pins that move out from at least one disk into the winding area. A pin drive may be provided for the pins that can be switched corresponding to the progressing winding. It is also contemplated to equip the rotary drive with only one disk onto which the carrier strip is wound and into which the deflecting means are inserted.

In a further embodiment of this device, two coaxial pins are provided that each extend in parallel to the shaft of the disks and are arranged in the disks opposite one another. By this measure, a further automation and acceleration of the winding process is possible. It is especially advantageous for the outer surfaces of the pins to form deflecting edges. This results in a more precise fixing of the deflection points during the winding of the carrier strip.

Lastly, it is contemplated to provide a device for the deforming of the carrier matrix and for adapting of its shape to the shape of the sheath. By means of this device, the carrier matrix, after the pins that serve as the deflection means are removed, is either first deformed and then inserted into the sheath, or during the insertion into the sheath is at the same time deformed into the final shape of the carrier matrix.

Further objects, features, and advantages of the present invention will become more apparent from the following description when taken with the accompanying drawings which show, for purposes of illustration only, an embodiment in accordance with the present invention.

BRIEF DESCRIPTION OF THE DRAWINGS

FIG. 4*a* is a cross-sectional shape for a further embodiment of a carrier matrix;

FIG. 4*b* is a cross-section of a triangular winding body;

FIG. 4*c* is a cross-section of a ring-shaped winding body;

FIG. 5 is a cross-section of a carrier matrix that is composed of three carrier matrix parts and is inserted in a sheath;

FIG. 6 is a schematic representation of a preferred embodiment of a winding device;

FIG. 7 is a partial sectional view of one preferred embodiment of the winding device according to FIG. 6;

FIG. 8 is a partial sectional view of a further preferred embodiment of the winding device according to FIG. 6; and FIG. 9 shows an inserting device.

DETAILED DESCRIPTION OF THE DRAWINGS

Figure 1:
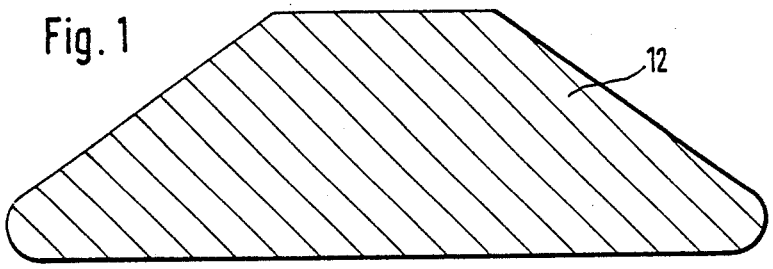
FIG. 1 is a cross-sectional shape for a carrier matrix.

FIG. 1, by means of a shaped surface 12, shows a desired cross-sectional shape of a carrier matrix that, for example, is required because the carrier matrix is fastened in the area of the drive shaft tunnel of a motor vehicle and must fill out all of the available space. The making of a carrier matrix having the cross-sectional shape shown in FIG. 1 is explained in the following and by FIG. 2.

Figure 2:
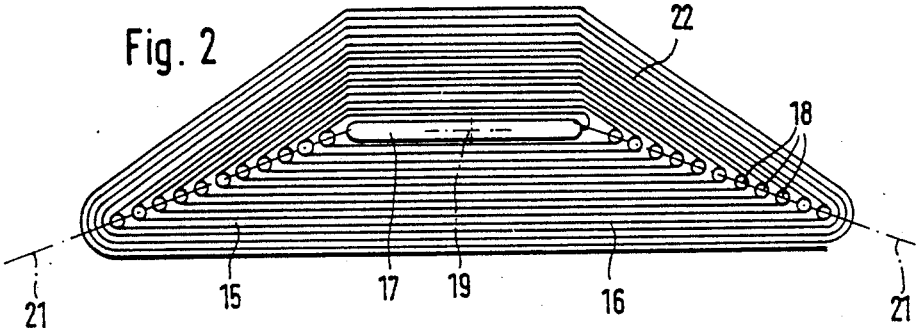
FIG. 2 is the cross-section of a wound carrier matrix before insertion into a sheath.

In FIG. 2, a carrier matrix 15 is shown that has a high-temperature-resistant, metallic carrier strip 16 which is wound around a winding core 17 and around deflection means 18. A rotating shaft 19 in this embodiment forms the center of the winding. The reference numeral 22 generally designates a single winding layer of the carrier matrix 15 that in each case comprises one full winding of the carrier strip 16 around the winding core 17.

The carrier strip 16 in this illustrated embodiment comprises one smooth and one undulated metal strip, the width of the carrier strip 16 corresponding to the desired axial length of the carrier matrix 15. In a preferred embodiment, the wound carrier strip has the shape of a strip that is profiled to have a trapezoidal cross-section. The winding core 17 is of an oblong shape, while the deflecting means 18 are cylindrical bodies The deflection means 18 are arranged at both sides of the winding core 17 in planes 21 and 21' which with the plane of the winding core 17 in each case encloses an obtuse angle. In an alternate embodiment, the deflection means 18 are arranged to be staggered, and particularly zigzag-shaped, with respect to the plane 21, 21'.

The carrier strip 16 is fastened at the right end (as seen in FIG. 2) of the winding core 17 and rests on its top side. At the left end of the winding core 17, the carrier strip 16 is guided via a deflection means 18, parallel to the bottom side of the winding core 17, to a deflection means 18 located at the right end of the winding core 17. In this manner, one winding layer 22 of the carrier matrix 15 is created. Subsequently, the carrier strip 16 either rests on the preceding winding layer 22 or is wound around another deflection means 18. The individual deflection means 18 in this embodiment are inserted successively, in other words after the winding layer extending under the deflection means 18 to be inserted is wound up. This is only shortly before the carrier strip 16 is to be wound over the respective deflection means 18. The method of how the winding core 17 and the deflection means 18 are inserted into the carrier matrix 15 and fastened will be explained later. By the winding up of the carrier strip 16 onto the winding core 17 and over the deflection means 18, a carrier matrix 15 is obtained that has a trapezoidal shape.

Figure 3:
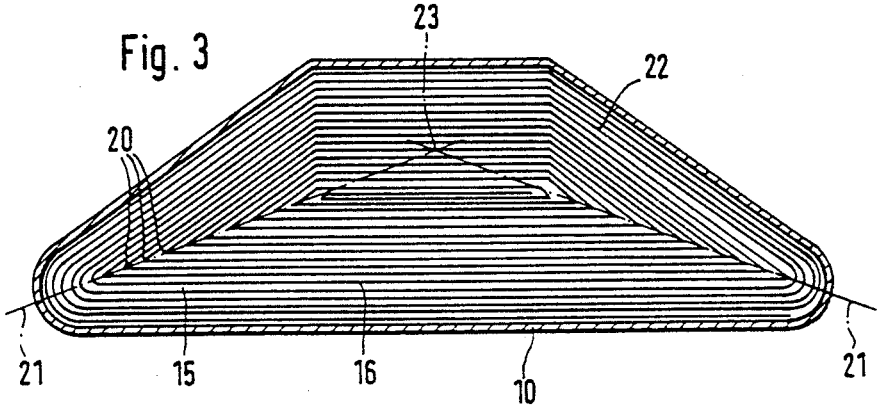
FIG. 3 is the cross-section of a carrier matrix inserted in a sheath.

In FIG. 3, the completely wound carrier matrix 15 of FIG. 2 has been inserted in a sheath 10, the cross-section of which corresponds to the cross-section 12 shown in FIG. 1. The carrier matrix 15 of FIG. 2 was inserted into this sheath 10 after the winding core 17 and the deflection means 18 were moved from the carrier matrix 15. By inserting the carrier matrix 15 into the sheath 10, deflection points 20 were formed which are located on both sides of the winding core 17 in each of the planes 21, 21'. Depending on the bend of the carrier strip 16 at a deflection point 20, the deflection points 20 have a greater or lesser acute angle. The two planes 21, 21', containing the deflection points 20 form an obtuse angle with the two parallel lateral surfaces of the carrier matrix 15 and intersect at intersection 23.

The sheath 10 is made of steel in preferred embodiments and already has the desired cross-section shown in FIG. 1 before the inserting of the carrier matrix 15 of FIG. 2. The manufacturing of the sheath 10 is conventional. The method of insertion of the carrier matrix 15 into the sheath 10 will be described later.

In FIG. 2, the deflection means 18 are arranged in such a way that, by means of the winding alone, the approximate desired cross-section of the carrier matrix 15 is obtained. In order to produce a different cross-section, it is only necessary to arrange the deflection means 18 differently and wind the carrier strip 16 around them. However, it is not necessary to produce a winding body during the winding of the carrier strip 16 that has its largely final shape. For some contemplated profiles, it is advantageous to use no winding core 17 and start the winding of the carrier matrix 15 immediately with the aid of deflection means 18. In these cases, the beginning of the carrier strip 16 may be fastened at a deflection means 18 or at the winding shaft 19. It is also contemplated to use differently shaped winding cores 17 and/or deflection means 18.

To produce an arbitrary cross-section of a carrier matrix 15 when an elastically deformable carrier strip 16 is used, it is not the physical positioning of the deflection means 18 which is decisive, but the circumferential length of each individual winding layer 22 of the carrier matrix 15. Based on the desired cross-sectional shape, this circumference can be determined or measured before the winding of the carrier matrix for each individual winding layer 22. The successive deflection points 18, may now be arranged arbitrarily in space as long as the resulting winding layers have the corresponding circumferential lengths. Based on the elastic deformability of the carrier strip 16, it is possible, after the winding of the carrier matrix 15, and the removal of the core 17 and the deflection means 18, to press the carrier matrix 15 into the desired shape when it is inserted into the sheath 10 without plastic deformations of the carrier matrix 15 occurring.

It is especially advantageous to arrange the deflection means 18 as star-shaped as possible, for example, in the shape of a rectangular cross originating from the winding shaft. This makes it possible to wind the carrier matrix 15 with a high and uniform winding speed without having to provide complicated winding drives.

FIG. 4*a*, by means of a shaded surface 32, shows a desired cross-section of another carrier matrix. A carrier matrix of this type is made from a total of three winding bodies from the carrier strip 16, two of which have the triangular cross-section of the winding body 35 shown in FIG. 4*b* and one which has the ring-shaped cross-section of the winding body 36 shown in FIG. 4*c*.

The winding bodies shown in FIGS. 4*b* and 4*c* are produced analogously to FIGS. 1 to 3, but for the winding body of FIG. 4*b*, no winding core is used and the deflection means 39 are arranged in a star shape. In the winding body of FIG. 4*c*, a core 38 and deflection means 39 are used, the deflection means 39 being arranged in the shape of a line.

FIG. 5 shows a carrier matrix 15 that is located in a sheath 30, the cross-section of which corresponds to the cross-section shown in FIG. 4*a*. The carrier matrix 15 comprises the two winding bodies 35 and the winding body 36 of FIGS. 4*b* and 4*c*. The two winding bodies 35, after the removal of the winding core 38 and the deflection means 39, are inserted into the interior of the winding body 36. The winding body 36, on its top side, is then acted upon by a force 37. As a result, the upper part of the ring-shaped winding body 36 is pushed inwardly so that the whole carrier matrix 15 can then be inserted into the preformed sheath 30. By combining several winding bodies into one carrier matrix, arbitrarily chosen cross-sections of the carrier matrices can be produced. In Particular, it is possible to provide a carrier matrix with a concave arching, as shown in FIG. 5.

FIG. 6 shows a preferred embodiment of winding device 50 for the making of a carrier matrix. For this purpose, two winding disks 52, by means of a shaft 51, are connected with one another in a torsionally fixed manner. Identical bores 53 arranged in radially directed planes are located in each winding disk 52. The whole winding arrangement 50 is turned manually or by corresponding driving machines around the rotating shaft 19. For the winding of a carrier matrix, the beginning of the matrix is fastened at the shaft 51 and the winding device 50 is then set into a rotating motion. If, during the winding process, a deflection means 55 is to be inserted between the winding layers, this deflection means 55, through the corresponding bore 53, is inserted into the area between the two winding disks 52 and the carrier strip is wound along over it, as shown in FIG. 7.

FIG. 7 shows a partial sectional view of a preferred embodiment of the winding device 50 of FIG. 6, in the area of the connection of the shaft 51 and the winding disk 52. As an example, this connection is shown by means of a screw 58, and pins 73 provide torsional stability. As mentioned initially, the carrier strip 16 consists of an undulated strip and a smooth strip, which in FIG. 7 have the reference numerals 57 and 56 respectively. The distance between the two strips 56 and 57 is created by the profiling of the undulated strip 57.

A deflection pin 55 is shown that extends into the winding area 66 between the two winding wheels 52. The smooth strip 56 of the carrier strip 16 rests on this pin 55. The bore 53 guides the pin 55 into the winding area 66, and has an edge 67, by which the carrier strip 16 is bent and thus receives the angular shape of the deflection 20 shown in FIG. 3. Each pin 55 extends in Parallel to the rotating shaft 19 of the winding arrangement 50 and, for the formation of a deflection 20, is fitted through two correlated bores 53 of the two winding disks 52.

In an especially preferred embodiment, for the formation of a deflection point 20, two pins are fitted into two correlated opposite bores 53 of the two winding disks 52. The two pins extend coaxially and only reach slightly into the winding area 66. Due to the stability of the carrier strip 16, particularly because of its profiling, it is sufficient for the formation of the deflections 20 to guide the carrier strip 16 only at its edge over corresponding pins 55. It is contemplated to wind the carrier strip 16 up on only one winding disk 52 and to fit it only with pins 59 for the formation of the deflection points 20.

FIG. 8 also shows a partial sectional view of a further preferred embodiment of the winding arrangement 50 according to FIG. 6. In this embodiment, the individual deflection means are moved automatically into the winding area. For this purpose, pins 59 are located in the bores 53 of the winding wheel 52 of FIG. 8. The pins 59, by means of springs 62, are pressed out of the winding area 66. The springs 62 are located in the recesses 63 between the winding wheel 52 and the pins 59. A slider 60 is connected with the winding wheel 52 by a holding device 61. The slider 60 is arranged on the exterior side of the winding wheel 52 such that it may be pushed along over the pins 59. When the slider 60, with its diagonal front surface 65, reaches a pin 59, the forward movement of the slider 60, via the diagonal surface 64 of the pin 59, is translated into a movement of the pin 59. As a result, the tip of the pin 59 reaches into the winding area 66 which, and by the winding-over of the carrier strip 16, results in its deflection 20. When the pin 59 is pressed in, the spring 62 is compressed so that, when the slider 60 is pulled back and the pin 59 is therefore released, this pin 59 is automatically pulled out of the winding area 66.

It is especially advantageous to provide the pins 59 with a triangular cross-section, so that the tip of the triangle points away from the shaft 51 and forms an edge for the carrier strip 16. In a contemplated embodiment the slider 60 is connected with the device (not shown) that drives the whole winding arrangement 50 so that the individual pins 59 are inserted automatically into the winding area 66 at the correct point in time in the winding process.

In further contemplated embodiments, the individual pins 59 have differing lengths so that in the starting position, they project out of the disk 52 at differing distances. A plate (not shown) which is parallel to the winding disk 52 that is moved toward it will then press the individual pins 59 successively into the winding area 66. The point in time of the pressing-in for an individual pin 59 depends on the length of the respective pin 59.

Also contemplated are other devices which move the individual pins 59, for example, hydraulically, pneumatically or by means of electrically or electronically controlled magnetic valves. When electronic devices are used, for example, the advantageous provision of a correspondingly programmed computer is contemplated. In addition to controlling the rotating speed of the winding arrangement and the point in time of the inserting of the individual pins for the formation of deflection points, the contemplated computer will control the providing of a bend or perforation or the like in the carrier strip, before it is wound up, at the corresponding points.

After the carrier matrix is wound and any winding cores and deflection pins that may have been used are removed, the carrier matrix, by means of the device shown in FIG. 9, is placed in the sheath and is changed into its final shape. During this process, as mentioned before, the cross-section of the carrier matrix may be changed without plastically deforming the carrier matrix and especially the profiling of the carrier strip. This is possible since the circumferences of the individual winding layers of the carrier matrix are adapted to the desired shape by the deflection points of the carrier matrix.

In FIG. 9, a funnel 70 leads into a holding device 72 in which the sheath 10 is placed. The outlet cross-section of the funnel 70 and of the holding device 72 corresponds to the cross-section of the sheath 10. The carrier matrix 15 is move forward in direction 71 so that its cross-section, because of the cone-shaped surfaces of the funnel 70, deforms automatically into the cross-section of the sheath 10.

It is also contemplated to insert the carrier matrix 15 into the sheath 10 by means of other devices. For example, plane jaws that at least partially have the shape of the desired cross-section of the carrier matrix, may hold the carrier matrix at the exterior surface and possibly deform it in order to then, by means of a plunger, insert it into the sheath. A sheath comprising several parts which forms the plane jaw is contemplated. In this contemplated embodiment, the individual parts of the sheath, after the insertion of the carrier matrix, must, for example, be welded together.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A catalytic converter carrier matrix arrangement for exhaust emission control in internal combustion engines comprising:

carrier strip means wound into winding layers with adjacent layers abutting one another to form a carrier matrix, said carrier strip means including undulations which serve to space adjacent winding layers from one another and provide exhaust gas flow accommodating openings which extend transversely of the carrier strip means, wherein said carrier strip means are wound with a plurality of deflections in each winding layer to form said carrier matrix into a geometric shape with at least one non-curvilinear side, whereby said carrier matrix can be inserted in corresponding geometric shape sheath means.

2. An arrangement according to claim 1, wherein said geometric shape is a trapezoid.

3. An arrangement according to claim 1, wherein said geometric shape is a triangle.

4. An arrangement according to claim 1, wherein said geometric shape is a semi-circle.

5. An arrangement according to claim 1, wherein said geometric shape comprises two adjacent triangles.

6. An arrangement according to claim 1, wherein said matrix includes a pair of separate triangular shape multiple winding layers surrounded by further multiple winding layers.

7. An arrangement according to claim 1, wherein a plurality of deflections for adjacent winding layers are disposed in a common plane, further comprising deflection pins at each of said deflections, whereby an intermediate matrix product is provided for later processing with removal of said deflection pins.

8. An arrangement according to claim 1, wherein at least some of said deflections are formed by deflection pins which are removed after the matrix is formed.

9. An arrangement according to claim 8, wherein a plurality of said deflections are disposed along a plane which bisects an angle formed by the intersection of respective planes through winding layers of the matrix.

10. An arrangement according to claim 2, wherein a plurality of said deflections are disposed along a plane which bisects an angle formed by intersection of respective planes through winding layers of the matrix.

11. An arrangement according to claim 1, further comprising matrix sheath means surrounding the matrix in close fitting relationship with elastic prestressing of the matrix against inside walls of the matrix sheath means, said sheath means having a geometric shape corresponding to the geometric shape of the matrix.

12. A process for manufacturing a catalytic carrier matrix arrangement for exhaust emission control in internal combustion engines comprising:

winding a carrier strip means into winding layers abutting one another to form a carrier matrix, said carrier strip means including undulations which serve to space adjacent winding layers from one another and provide exhaust gas flow accommodating openings which extend transversely of the carrier strip means, wherein said carrier strip means are wound with a plurality of deflections in each winding layer to form said carrier matrix into a geometric shape when at least one non-curvilinear side whereby said carrier matrix can be inserted in corresponding geometric shape sheath, and wherein said deflections are formed by inserting deflection means into respective one of said winding layers during winding of said carrier strip means.

13. A process according to claim 12, wherein said deflection means are successively inserted in a winding layer which is outermost.

14. A process according to claim 12, wherein said deflection means are removed from said carrier matrix after it has been wound.

15. A process according to claim 12, comprising inserting the carrier matrix into a corresponding geometric shape matrix sheath with elastic prestressing of the carrier matrix against inner walls of the matrix sheath.

16. A process according to claim 15, comprising deforming the matrix into its final shape prior to insertion thereof in the sheath.

17. A process according to claim 15, comprising deforming the matrix into its final shape during insertion thereof into the sheath.

18. A process according to claim 15, wherein a distance between said deflections and said carrier strip after deforming of said carrier matrix corresponds to a distance between said successively inserted deflection means.

19. A process according to claim 15, wherein said carrier strip is wound such that a hollow space for accommodating separately produced carrier matrix parts is created.

20. A process according to claim 12, wherein said carrier strip is provided with weakened sections which correspond to said deflections.

21. A process according to claim 12, wherein said deflection means are deflections pins, comprising removing the deflection pins from the matrix after the matrix is formed.

22. A process according to claim 21, wherein a plurality of said deflections are disposed along a plane which bisects an angle formed by the intersection of respective planes through winding layers of the matrix.

23. A process according to claim 22, wherein said geometric shape is a trapezoid.

24. A process according to claim 28, comprising inserting the carrier matrix into a corresponding geometric shape matrix sheath with elastic prestressing of the carrier matrix against inner walls the matrix sheath.

25. A process according to claim 22, wherein said geometric shape is a triangle.

26. A process according to claim 22, wherein said geometric shape is a semi-circle.

27. A process according to claim 22, wherein said matrix includes a pair of separate triangular shape multiple winding layers surrounded by further multiple winding layers.

28. A device for winding a carrier strip means into a carrier matrix with the carrier strip means wound into winding layers with adjacent layers abutting one another to form a catalytic carrier matrix, said carrier strip means including undulations which serve to space adjacent winding layers from one another and provide exhaust gas flow accommodating openings which extend transversely of the carrier strip means, wherein said carrier strip means are would with a plurality of deflections in each winding layer to form said carrier matrix into a geometric shape with at least one non-curvilinear side such that said carrier matrix can be inserted in corresponding geometric shape sheath means, and wherein said device comprises two disks connected with one another in a torsionally fixed matter by a rotating shaft, rotating drive means for said shaft, at least one of said disks being provided with receiving means for receiving deflection means at a distance from rotating shaft, said deflection means serving to form said deflections in each winding layer during rotation of the shaft, wherein means are provided for removing said deflection means from said carrier matrix after the carrier matrix is formed into said geometric shape.

29. A device according to claim 28, wherein the receiving means are bores extending in parallel to the rotating shaft.

30. A device according to claim 29, wherein the bores are arranged in lines in a star-shaped manner.

31. A device according to claim 30, wherein said deflection means are pins that are movable at least out of one disk into a winding area.

32. A device according to claim 31, wherein pin drive means is provided for moving said pins, said pin drive means being switchable during said winding.

33. A device according to claim 32, wherein two pins extending in parallel to the rotating shaft are arranged in the disks opposite one another.

34. A device according to claim 33, wherein exterior surfaces of the pins form deflection edges.

35. A device according to claim 34, wherein the distances between successively inserted pins during the progression winding corresponds to the length of the carrier strip between deflections in the carrier strip after it is deformed.

36. A device according to claim 35, including adapting means for deforming the carrier matrix and adapting the shape of the carrier matrix to the shape of a sheath.

37. A device according to claim 36, including weakening means for equipping the carrier strip with weak points assigned to the deflections.

* * * * *